United States Patent [19]

Niemoeller

[11] 4,447,050

[45] May 8, 1984

[54] WOOD KERF CHUCK

[76] Inventor: Charles W. Niemoeller, 1091 Geneva Dr., Prescott, Ariz. 85012

[21] Appl. No.: 319,549

[22] Filed: Nov. 9, 1981

[51] Int. Cl.[3] ..... B25B 5/14

[52] U.S. Cl. ..... 269/49

[58] Field of Search ..... 269/37, 43, 47, 49, 269/243, 41, 203; 29/271, 238; 24/263 R; 403/310, 311, 312

[56] References Cited

U.S. PATENT DOCUMENTS

| | | | |
|---|---|---|---|
| 1,336,291 | 4/1920 | Gilmore | 29/238 |
| 2,133,892 | 10/1938 | Gelinski | 269/249 |
| 2,148,156 | 2/1939 | Hagopian | 269/203 |
| 2,635,320 | 4/1953 | Ornitz | 269/203 |
| 2,770,271 | 11/1956 | Kane | 269/203 |
| 2,786,372 | 3/1957 | Lassy | 269/203 |
| 3,062,261 | 11/1962 | Chesser | 29/238 |
| 3,173,674 | 3/1965 | Ringle | 269/249 |
| 3,342,479 | 9/1967 | Howe | 269/49 |
| 4,076,228 | 2/1978 | Sheldon | 269/49 |

FOREIGN PATENT DOCUMENTS

| | | | |
|---|---|---|---|
| 431131 | 9/1933 | United Kingdom | 24/263 R |
| 767182 | 1/1957 | United Kingdom | 29/239 |

*Primary Examiner*—Robert C. Watson

*Attorney, Agent, or Firm*—Cates & Roediger

[57] ABSTRACT

A wood, or the like, kerf chuck of two substantially identical pieces are disposed parallel to each other for clamping a board between them. A vertical kerf member extends from one piece through a saw kerf and lies alongside a similar vertical member which extends from the other piece. A bolt and thumb screw attach the vertical members in order to maintain the established separation between base and clamp jaws.

1 Claim, 5 Drawing Figures

WOOD KERF CHUCK

BACKGROUND OF THE INVENTION

Clamps or chucks, for use in holding the two parts of a board or panel together after a saw cut has been made and is continuing are known to the art. One form of such a clamp is shown in the U.S. Pat. No. 4,076,228 entitled "Kerf Clamp" dated Feb. 28, 1978. It is an object of the invention to provide an improved clamp or chuck of this nature.

Whenever a lengthy saw cut is made through a relatively large piece of material, such as a wood panel, for example, there is the problem of holding the two pieces of material, in their original relative position while the saw cutting continues across the remainder of the piece of material. This is a common occurrence and has been experienced by almost everyone making a cut into a large piece of material. Saw horses and other means of support are only a partial solution to the problem. The clamp of the U.S. Pat. No. 4,076,228 referred to above presents a solution to this problem. Such devices or clamps comprise a base part to be disposed on the under side of the saw cut or kerf, a member extending through the kerf attached to the base part, a cover part to be disposed on the upper side of the kerf of the material being cut and some form of screw, for example, a thumbscrew arrangement for holding the parts together, one on each side of the saw kerf.

The clamps of the prior art are relatively bulky and are difficult to use. Accordingly, it is an object of the invention to provide an improved kerf clamp or chuck which will obviate the disadvantages of the prior art.

BRIEF DESCRIPTION OF THE INVENTION

It is a further object of the invention to provide an improved kerf chuck of the nature indicated which is light in weight, simple in form and easy to use.

It is a further object of the invention to provide an improved kerf chuck of the nature indicated in which the individual pieces may be formed from relatively thin sheets of material and stamped into the form desired with very little loss of material.

In carrying out the invention according to one form there is provided a kerf chuck comprising in combination a base jaw, a vertical kerf member extending from the base jaw and adapted to extend through a kerf, a clamp jaw adapted to be disposed parallel to the base jaw, a vertical holding member extending from the clamp chuck and adapted to be disposed alongside the vertical kerf member, and screw-nut clamp means for holding the vertical kerf member and the vertical holding member together.

In carrying out the invention according to another form there is provided the kerf chuck comprising in combination a base jaw having a first base part and two spaced apart first fingers, a vertical kerf member extending from the first base part between the first fingers and adapted to extend through a kerf, a clamp jaw having a second base part and two spaced apart second fingers, a vertical holding member extending from the second base part between the second fingers and adapted to be disposed alongside the vertical kerf member, the base jaw including downwardly extending stiffening beads alongside the edges thereof, the clamp jaw including upwardly extending stiffening beads alongside the edges thereof, the vertical kerf member and the vertical holding member each including a longitudinal slot, and screw nut clamp means extending through the longitudinal slots for holding the vertical kerf member and the vertical holding member together.

Further objects and advantages of the invention will become apparent as the description proceeds.

DESCRIPTION OF THE DRAWINGS

For a clearer understanding of the invention reference should now be had to the accompanying drawings in which.

DESCRIPTION OF THE PREFERRED EMBODIMENT

Figure 1:
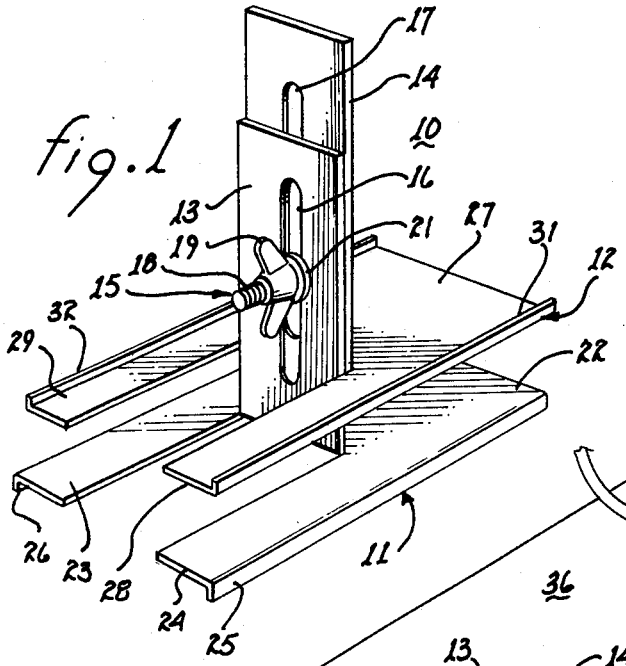
FIG. 1 is a perspective view of a kerf chuck according to the invention.
Figure 5:
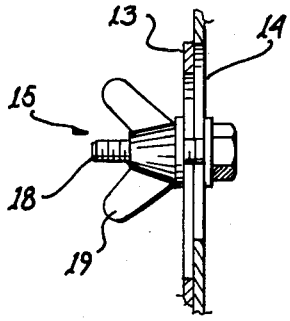

Referring to the drawings, the invention is shown embodied in a kerf chuck 10 comprising a base jaw 11, a clamp jaw 12, a vertical kerf member 13 extending from the base jaw 11, a vertical holding member 14 extending from the clamp jaw 12 and a screw member 15 for holding the vertical kerf member and the vertical holding member together.

The vertical kerf member 13 includes an elongated longitudinal slot 16 and the vertical holding member 14 includes an elongated longitudinal slot 17 which are disposed adjacent to each other when the kerf member 13 and the holding member 14 are disposed adjacent to each other as may be seen best in FIG. 1. The screw member 15 includes a bolt 18 and a wing nut 19, for example, the bolt 18 being disposed through the adjacent slot 16 and 17 and together with a washer 21 the wing nut and bolt clamp the kerf member 13 and the holding member 14 together when the device is in use. The base jaw 11 includes a base part 22 and a pair of fingers 23 and 24 spaced from each other and extending from the base part 22.

The space between fingers 23 and 24 was occupied by the vertical kerf member 13 before the parts were formed as will become clear. Along one side of the base part 22 and the extending finger 24 is a stiffening bead or flange 25 and along the opposite side of the base part 22 and along side the finger 23 is a stiffening bead or flange 26. Similarly the clamp jaw 12 includes a base part 27 and two spaced apart fingers 28 and 29 extending therefrom. This space between fingers 28 and 29 was occupied by the vertical holding member 14 before the holding member 14 was cut from the blank of material as will be described. Extending along one side of the base part 27 and the finger 28 is a stiffening bead or flange 31 and extending along the opposite side of the base part 27 and alongside the finger 29 is a stiffening bead or flange 32. The beads 25 and 26 are disposed downwardly on the base part 22 and the fingers 23 and 24 so as to provide a smooth upper surface and the beads 31 and 32 are disposed upwardly from the base part 27 and the fingers 28 and 29 so as to provide a smooth undersurface both for receiving a board 33, for example, between the base jaw 11 and the clamp jaw 12 as may be visualized in FIG. 2.

Figure 2:
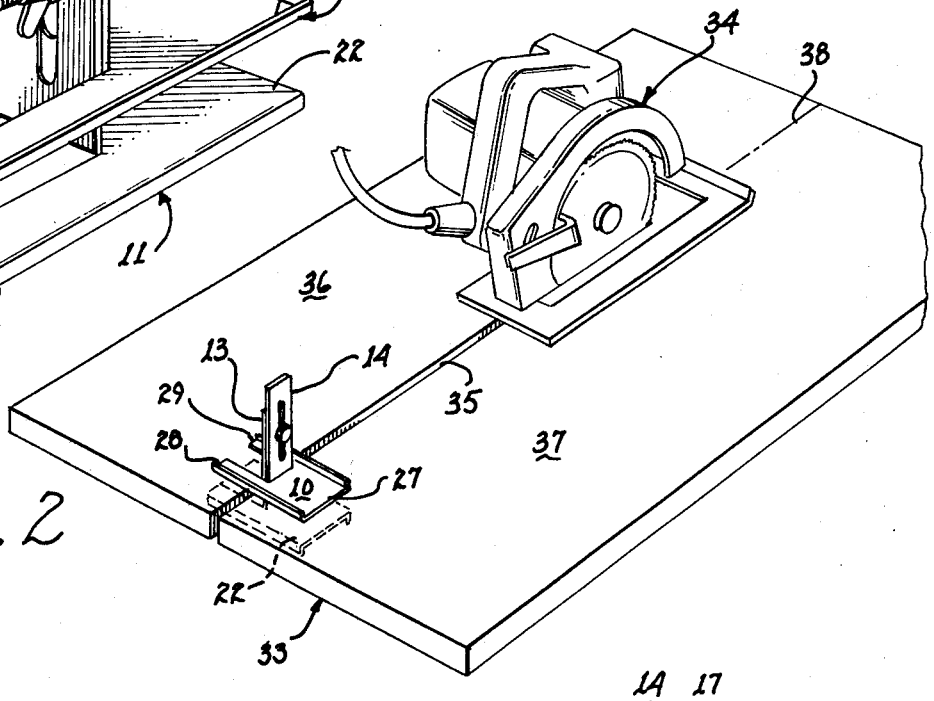
FIG. 2 is a perspective view showing use of the kerf chuck according to the invention in an application.

In FIG. 2 the kerf chuck 10 is shown disposed in position upon a board 33 after a saw (shown schematically as 34) has cut a kerf 35 to form two board parts 36 and 37. As may be visualized in this figure, the board 33 may be supported in any ordinary fashion, such for example as on a pair of saw horses (not shown) and when the saw has formed the kerf 35 for a relatively small distance the kerf clamp 10 is disposed in position to support the two board parts 36 and 37 in their original relative position. This, thereby, frees the hand of the sawyer to move the saw along the direction of the kerf as shown by the dotted line 38. The base part 22 and the fingers 23 and 25 bear against the undersurface of the boards 36 and 37, and the base part 27 and the fingers 28 and 29 bear against the upper surfaces of the boards 36 and 37. The kerf member 13 extends between the board parts 36 and 37 in the kerf 35.

Figure 3:
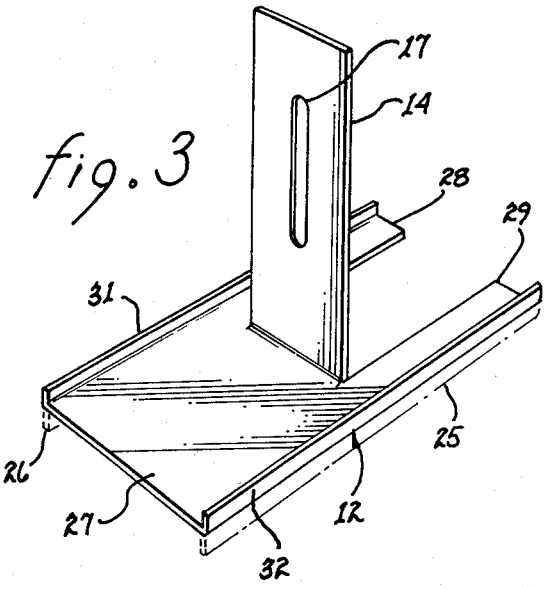
FIG. 3 is a perspective view of one element of the inventive structure.

In FIG. 3 the clamp jaw 12 is shown separate from the associated base jaw 11. The various parts of this structure as shown in FIG. 3 conform, of course, to the same parts as indicated by the corresponding reference characters shown in FIG. 1. The base jaw 11 is essentially the same as clamp jaw 12 except that the stiffening beads 25 and 26 are turned downwardly instead of upwardly in order to provide the smooth surfaces for use in the clamping operation as indicated.

Figure 4:
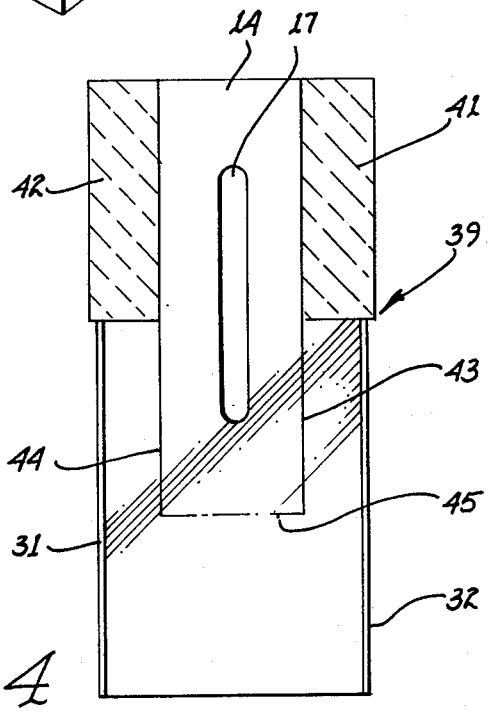
FIG. 4 is a somewhat schematic view of a blank piece from which the inventive parts may be made.

Referring to FIG. 4 there is shown partly schematically a blank piece 39 essentially rectangular in character and which would be used to form the clamp jaw 12. By any suitable shearing or stamping operation the excess pieces of material 41 and 42 are sheared away and, at the same time, cuts are made along the lines 43 and 44 thereby forming the vertical holding member 14 which when bent vertically at the dotted line 45 will project vertically as seen in the preceding figures. If desired, of course, for small operations the excess material 41 and 42 may be cut off by a sawing operation and the cuts 43 and 44 formed in the same manner. At the same time and by whatever process is used the longitudinally extending elongated slot 17 is formed. The stiffening beads 31 and 32 may be formed by individual bending operations or in a die stamping operation. From a blank similar to that shown in FIG. 4 the same operations may be performed, with the exception that the beads 25 and 26 are formed downwardly for forming the base jaw 11 as described.

Whatever thickness, stiffness and material are desired may be used. One form of jaws have been formed from cadmium plated 18GA galvanized steel approximately 1/32nd of an inch in thickness.

The kerf chuck 10 comprising the base jaw 11 and the clamp jaw 12 together with the screw member 15 is simple to make and easier to use in performing its desired function.

It will be evident that the invention may be carried out in other ways in addition to the one illustrated in the described figures. It is intended by the appended claims to cover all forms of the invention within the scope of the disclosure.

I claim:

1. The kerf chuck comprising in combination a base jaw having a first base part and two spaced apart first fingers, a vertical kerf member extending from said first base part between said first fingers and adapted to extend through a kerf, a clamp jaw having a second base part and two spaced apart second figures, a vertical holding member extending from said second base part between said second fingers and adapted to be disposed alongside said vertical kerf member, said base jaw including downwardly extending stiffening beads alongside the edges thereof, said clamp jaw including upwardly extending stiffening beads alongside the edges thereof, said vertical kerf member and said vertical holding member each include a longitudinal slot, and screw nut clamp means extending through said longitudinal slots for holding said vertical kerf member and said vertical holding member in their original relative positions.

* * * * *